US006750556B2

(12) United States Patent
Sodemann et al.

(10) Patent No.: US 6,750,556 B2
(45) Date of Patent: Jun. 15, 2004

(54) REMOVABLE FUEL TANK

(75) Inventors: Wesley C. Sodemann, Dousman, WI (US); Stacy Paul DeGroot, Rio, WI (US)

(73) Assignee: Briggs & Stratton Power Products Group, LLC, Jefferson, WI (US)

( * ) Notice: Subject to any disclaimer, the term of this patent is extended or adjusted under 35 U.S.C. 154(b) by 71 days.

(21) Appl. No.: 10/106,433

(22) Filed: Mar. 26, 2002

(65) Prior Publication Data

US 2003/0184094 A1 Oct. 2, 2003

(51) Int. Cl.[7] ..... H02K 5/00
(52) U.S. Cl. ..... 290/1 A; 322/1; 123/3
(58) Field of Search ..... 290/1 A, 2, 40 R; 322/1; 123/2, 3

(56) References Cited

U.S. PATENT DOCUMENTS

| | | | | | |
|---|---|---|---|---|---|
| 1,343,485 | A | | 6/1920 | Shamberg | |
| 4,098,218 | A | | 7/1978 | Pichl | 115/17 |
| 4,175,630 | A | | 11/1979 | Fleisher et al. | 180/225 |
| 4,698,975 | A | | 10/1987 | Tsukamoto et al. | 60/721 |
| 4,827,147 | A | * | 5/1989 | Mizushima | 290/1 A |
| 4,958,599 | A | | 9/1990 | Yokoyama et al. | 123/41.5 |
| 5,186,324 | A | | 2/1993 | Brandon, Jr. | 206/223 |
| 5,212,952 | A | | 5/1993 | Yokoyama et al. | 60/721 |
| 6,039,009 | A | | 3/2000 | Hirose | 123/2 |
| 6,067,945 | A | * | 5/2000 | Fukuda et al. | 123/2 |
| 6,100,599 | A | | 8/2000 | Kouchi et al. | 290/1 A |
| 6,181,019 | B1 | * | 1/2001 | Frank | 290/1 A |
| 6,310,404 | B1 | * | 10/2001 | Frank | 290/1 A |
| 6,313,543 | B1 | | 11/2001 | Frank | 290/1 A |
| 6,525,430 | B1 | * | 2/2003 | Asai et al. | 290/1 A |

* cited by examiner

*Primary Examiner*—Nicholas Ponomarenko
(74) *Attorney, Agent, or Firm*—Michael Best & Friedrich LLP

(57) ABSTRACT

A generator embodying the invention comprises a removable fuel tank that is easily accessible, and may be easily removed from the generator. The generator includes a frame that supports an engine and the fuel tank. The fuel tank is removably interconnected to the frame with at least one quick release fastener. The quick release fastener may include a bolt, a pivoting tab, a clamp, or other similar quick release fasteners. Preferably, the quick release fastener may be engaged by hand, and does not require additional tooling. A fuel line between the fuel tank and the engine includes a quick disconnect attachment that prevents fuel flow and easily detaches the fuel tank from the engine. The fuel tank may be removed from the frame, taken to a gasoline station for refilling, and reattached to the generator for operation.

19 Claims, 4 Drawing Sheets

REMOVABLE FUEL TANK

FIELD OF THE INVENTION

This invention relates to engine-driven electrical generators, and more particularly to a fuel tank for such generators.

BACKGROUND OF THE INVENTION

Electrical generators are commonly used to provide electrical power in situations where conventional wired electrical power grid sources are not available, such as during a power outage, at construction sites, or at remote locations. The generator may use an engine to drive the generator. The generator may include a fuel tank to store gasoline and provide fuel for the engine. Some prior art generators include fuel tanks that are mounted to the generator.

When refilling the fuel tank, the operator may take the entire generator to a gasoline station, or a separate gasoline container may be used to transport fuel to the generator. Generators are typically heavy and cumbersome, and transporting the entire generator for a refill is typically not practical. Separate gasoline containers are additional items for an operator to obtain and have available when a refill is necessary. Separate gasoline containers may be easily misplaced and may require additional storage space.

Also, the operator may have to maintain each separate gasoline container full of gasoline. It may be desirable for an operator to have a reserve supply of gasoline stored in separate gasoline containers for extended use of the generator. In this situation, the operator may have to make a first trip to the gasoline station with separate gasoline containers to obtain gasoline for filling the generator fuel tank, and a second trip to refill the separate gasoline containers to maintain a reserve supply of gasoline.

Some separate gasoline containers may have a capacity that is less than the capacity of the generator fuel tank. For example, some generator fuel tanks have a capacity of 5 gallons, and may have a capacity of 10 gallons or more. A typical separate gasoline container may have a capacity of 2.5 gallons. Therefore, multiple gasoline containers or multiple trips to a gasoline station may be needed to refill the generator.

Also, generators are often needed during power outages. Separate gasoline containers may become relatively scarce during a power outage when demand for backup power increases. A shortage of gasoline containers during a power outage may require an operator to have multiple containers or make multiple trips to a gasoline station to maintain a supply of fuel for the generator. The separate gasoline containers also requires extra storage space, and may not be readily available when needed.

SUMMARY OF THE INVENTION

A generator embodying the invention comprises a removable fuel tank that is easily accessible and may be easily removed from the generator. The exposed, easily accessible, removable fuel tank provides a convenience for the operator because the removable fuel tank may be taken to a gasoline station for refilling, and reattached to the generator for operation. The removable fuel tank is readily available and is less likely to be lost than a separate gasoline container. Additionally, the removable fuel tank does not require additional storage space when not in use.

The generator includes a frame that supports an engine and the fuel tank. The engine powers the generator, and the fuel tank stores gasoline for the engine. The fuel tank is removably interconnected to the frame with quick release fasteners. The quick release fasteners may retain the fuel tank to the frame, and may hold the fuel tank and frame from substantially moving with respect to each other. Preferably, the quick release fasteners may be disengaged by hand without the use of additional tooling. A fuel line between the fuel tank and the engine may include a quick disconnect attachment that may shut off fuel flow and easily detach the fuel tank from the engine.

In the preferred embodiment, the quick release fastener includes a threaded fastener, such as bolt or screw, and may include a handle to facilitate engaging or disengaging the fastener by hand. The fuel tank may include a clamping portion, and the bolt may extend through a slot in the clamping portion and engage the frame. The bolt may include a disc-shaped flange that clamps the clamping portion to the frame. Alternatively, the quick release fastener may include other fasteners, such as clamps, pivoting tabs, key locks, elastic members, pins, latches, or other similar fasteners. Preferably, the quick release fasteners may be engaged by hand, and do not require a tool.

The fuel tank may be openly exposed near the top of the generator to provide easy access when refilling the fuel tank, and when detaching or reattaching the fuel tank. The fuel tank is preferably not enclosed within a housing. The fuel tank is readily available, and the operator does not have to locate a separate gasoline container when the generator requires refueling. The entire removable fuel tank may be refilled without the need for multiple gasoline containers or multiple trips to the gasoline station.

Additionally, it may be desirable to maintain a reserve fuel supply for operating the generator for extended periods of time. The operator may make a single trip to the gasoline station to refill the removable fuel tank and separate gasoline containers. With some prior art generators, separate trips to the gasoline station with separate gasoline containers were needed to first obtain gasoline for refilling the generator, and then refill the separate gasoline containers again for a reserve supply of gasoline. With the removable fuel tank, an operator may refill the generator, and refill separate gasoline containers for a reserve fuel supply in a single trip to the gasoline station. Therefore, the removable fuel tank may be particularly useful for initial filling of the fuel tank, and may help an operator to maximize a reserve gasoline supply while minimizing trips to the gasoline station.

Figure 1:
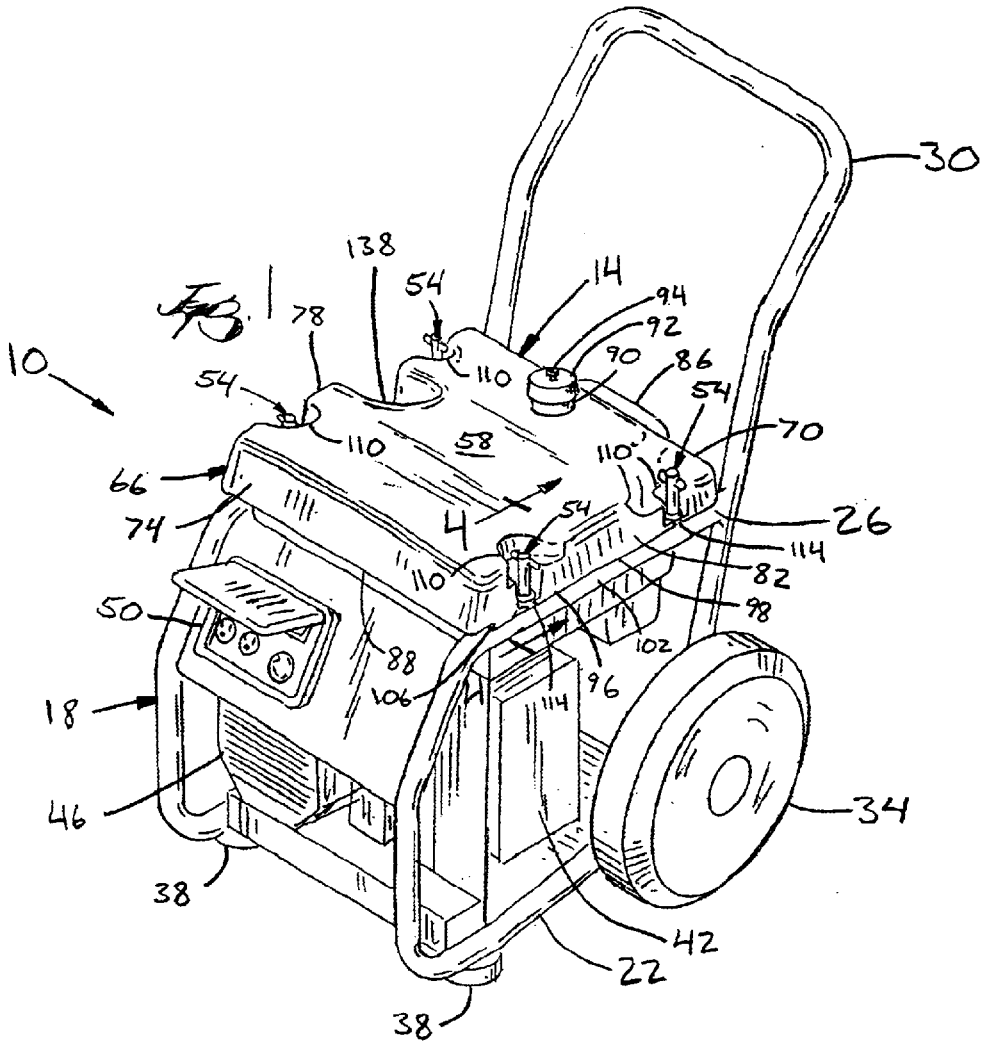
FIG. 1 is a perspective view of a generator having a removable fuel tank, according to the present invention.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

Although references are made below to directions, such as left, right, up, down, top, bottom, front, rear, back etc., in describing the drawings, they are made relative to the drawings (as normally viewed) for convenience. These directions are not intended to be taken literally or limit the present invention in any form.

DETAILED DESCRIPTION

FIG. 1 illustrates a portable generator 10 having a removable fuel tank 14. The generator 10 includes a frame 18 having a base 22, a support portion 26 disposed above the base 22, and a frame handle 30 projecting outwardly from the frame 18. The frame handle 30 may be movable to reduce the height of the generator 10 for storage or transport. Wheels 34 are interconnected to the frame 18 near the base 22 to facilitate transporting the generator 10. Stops 38 are also connected to the frame 18 near the base 22 to help provide stability while the generator 10 is stationary. FIG. 1 illustrates a portable generator 10 having wheels 34, but the removable fuel tank 14 may also be used with a stationary generator. The removable fuel tank 14 may be beneficial for a stationary generator since the entire stationary generator cannot be transported to refill the fuel tank 14.

An engine 42 is connected to the frame 18 and supported by the base 22. The engine 42 is generally disposed between the base 22 and the support portion 26. In the illustrated embodiment, the engine 42 is an approximately 10 HP engine, and the fuel tank 14 stores fuel for the engine 42. The fuel tank 14 is disposed above engine 42, and is openly exposed near the top of the generator 10 to provide easy access to the fuel tank 14. The generator 10 includes a gen-set 46 that generally convert mechanical power from the engine 42 into electrical current. The gen-set 46 may provide AC or DC current, and may include, among other things, a rotor, stator, or alternator.

As shown in FIG. 1, the generator 10 includes a control panel 50, having several electrical outlets. Various tools or appliances may be plugged into the control panel 50, and the generator 10 may provide power for the tools or appliances. In the preferred embodiment, the generator 10 provides an AC current of 105–125 Volts (V), 50–60 Hertz (Hz), and 20 Amps (A) through a conventional outlet in the control panel 50. Alternatively, the generator 10 may include a 120V–15A outlet, a 120V–30A locking type outlet, a 120/240V–20A locking type outlet, a 120/240V–30A locking type outlet, a 12V DC current outlet, or other similar outlets known to one skilled in the art.

The fuel tank 14 is removably interconnected to the frame 18 near the support portion 26. A quick release fastener 54 retains the fuel tank 14 to the frame 18. In the illustrated embodiment, the fuel tank 14 may have a capacity of approximately 5 gallons or more. The fuel tank 14 may be formed from a plastic material, or another similar substantially rigid material that is resistant to gasoline. The fuel tank 14 has a first face 58 that is substantially rectangular, a second face 62, and a wall 66 extending between the first face 58 and the second face 62. The first face 58 faces away from the engine 42, and the second face 62 faces toward the engine 42.

The wall 66 has a first end 70 and a second end 74 disposed opposite one another. The wall 66 also includes a first side 78 and a second side 82 disposed opposite one another, and adjacent the first end 70 and second end 74. In the illustrated embodiment, the first end 70 is located near the frame handle 30, and includes a C-shaped tank handle 86. The second end 74 is disposed opposite the first end 70 near the control panel 50, and includes a ridge 88 that extends inwardly from the second end 74. The tank handle 86 and ridge 88 facilitate carrying the fuel tank 14 when the fuel tank 14 is removed from the frame 18.

The fuel tank 14 includes a fuel opening 90 for refilling the fuel tank 14. In FIG. 1, the fuel opening 90 is located in the first face 58 near the top of the generator 10. The first face 58 and the fuel opening 90 are exposed near the top of the generator 10 to make the fuel opening 90 easily accessible. A fuel cap 92 may detachably engage the fuel opening 90 to enclose the fuel opening 90. In the illustrated embodiment, the fuel cap 92 may be threaded on and off of the fuel opening 90. The fuel cap 92 may include a vent 94 to release pressure within the fuel tank 14. Vapors within the fuel tank 14 may expand when the fuel tank 14 is sealed, and actuating the vent 94 to release pressure may help prevent removing the fuel cap 92 while the contents of the fuel tank 14 are under pressure.

The fuel tank 14 includes a clamping portion 96, and the frame 18 includes a retaining surface 98. In the illustrated embodiment, the support portion 26 includes elongated rods 102, and the retaining surface 98 is located near the top of the elongated rods 102. The clamping portion 96 is located adjacent the sides 78, 82 of the fuel tank 14. The retaining surface 98 is adjacent the clamping portion 96 when the fuel tank 14 is interconnected to the frame 18, and the retaining surface 98 may contact the clamping portion 96. The clamping portion 96 may be incorporated into an edge 106 extending along the sides 78, 82 of the fuel tank 14, and the fuel tank 14 may extend outwardly beyond the elongated rods 102. The quick release fastener 54 holds the retaining surface 98 and clamping portion 96 from substantially moving with respect to each other.

The fuel tank 14 may include a recess 110 in the sides 78, 82 that extends inwardly toward the fuel tank 14. As shown in FIG. 1, two recesses 110 extend into each side 78, 82. The clamping portion 96 may be at least partially disposed within the recess 110. A slot 114 extends into the clamping portion 96 within the recess 110. The quick release fastener 54 extends through the slot 114 and engages the frame 18 to retain the fuel tank 14 to the frame 18.

Figure 3:
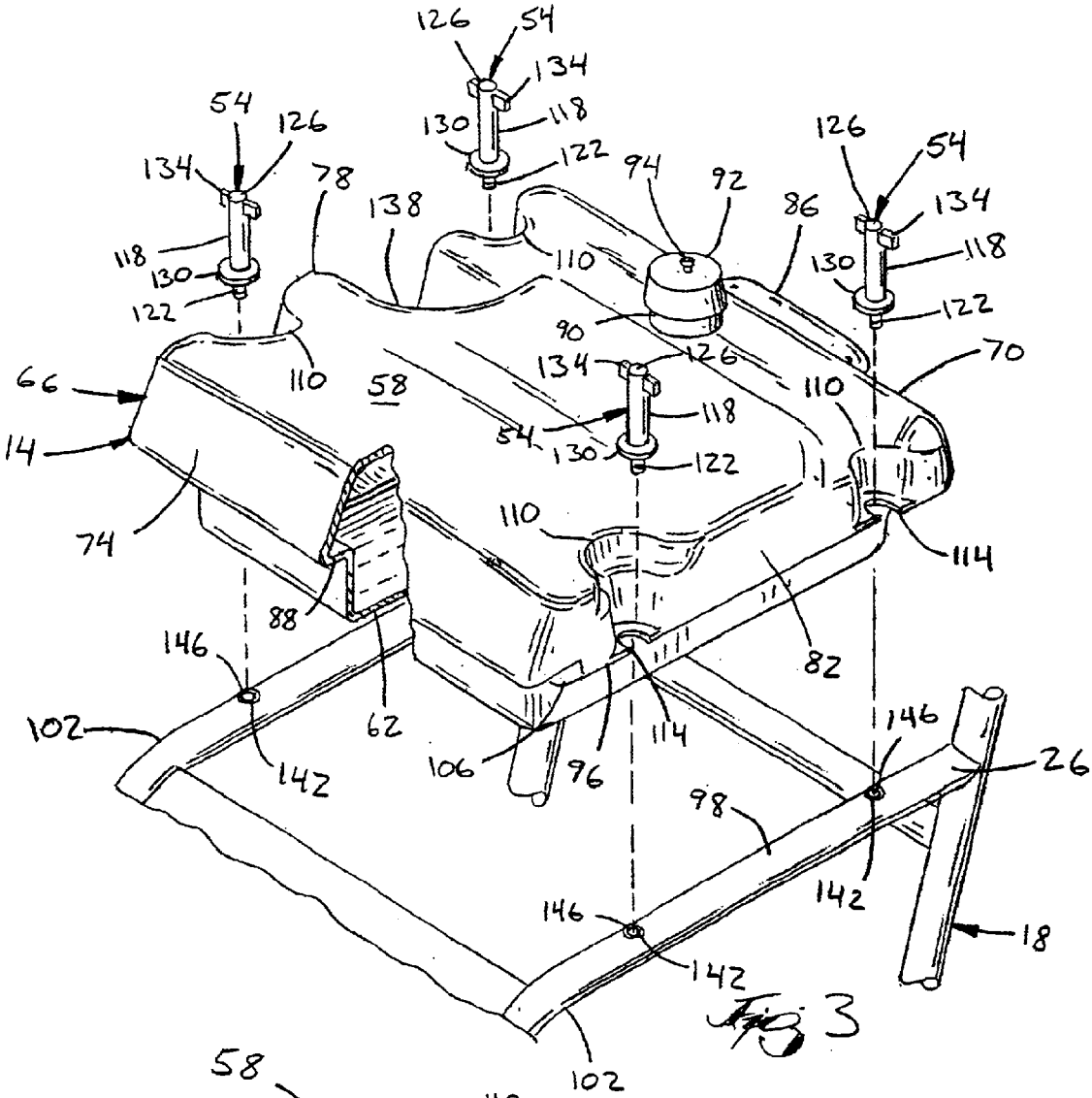
FIG. 3 is an exploded view of the fuel tank on the generator of FIG. 1.

FIG. 3 illustrates the fuel tank 14 removed from the frame 18. In the illustrated embodiment, the quick release fasteners 54 are bolts 118 having a threaded end 122 and a head 126 opposite the threaded end 122. A disc-shaped flange 130 projects radially outwardly from the bolt 118 adjacent the threaded end 122. The head 126 includes a wing handle 134 to facilitate tightening and loosening the bolt 118 by hand. In FIG. 3, the fuel tank 14 includes four bolts 118, one for each recess 110. The recesses 110 provide clearance to rotate and thread the bolts 118 into position, and reduce the overall height of the fuel tank frame assembly. The recesses 110 and bolts 118 are preferably located near the corners of the fuel tank 14 to evenly distribute support for the fuel tank 14. In the illustrated embodiment, the fuel tank 14 also includes an indentation 138 in the first side 78 between the other recesses 110. The indentation 138 may provide access to the engine 42 for maintenance purposes, such as checking and refilling oil in the engine 42.

Figure 4:
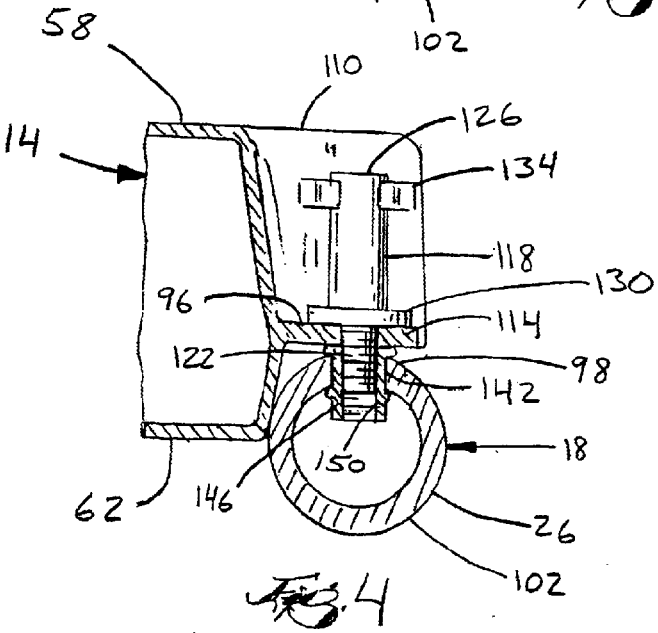
FIG. 4 is a cross sectional view taken along line 4—4 of FIG. 1.

The bolts 118 threadedly engage the support portion 26 to retain the fuel tank 14 to the frame 18. As shown in FIG. 3, the support portion 26 includes elongated rods 102, and the retaining surface 98 is disposed near the top of the elongated rods 102. In the illustrated embodiment, apertures 142 extend into the elongated rods 102. The apertures 142 are aligned with the slots 114, and the bolts 118 extend through the slots 114 and into the apertures 142. In FIG. 4, inserts 146 are disposed within the apertures 142, and have a threaded inner surface 150. The threaded end 122 of the bolt 118 engages the inner surface 150 of the insert 146. An air gun having a threaded attachment that engages the insert's threads is used to form flanges on the inserts 146. Alternatively, the threaded end 122 of the bolt 118 may directly engage the support portion 26.

The wing handle 134 permits the bolt 118 to be easily threaded in or out of the apertures 142. Preferably, the bolt 118 may be threaded by hand, and no additional tools are needed to insert or remove the bolt 118. As shown in FIG. 4, the clamping portion 96 is clamped between the disc flange 130 and the elongated rod 102 when the bolt 118 is tightened. The bolt 118 retains the fuel tank 14 to the frame 18, and holds the retaining surface 98 and clamping portion 96 from substantially moving with respect to each other.

As shown in FIG. 3 and mentioned above, the fuel tank 14 includes the ridge 88 near the first end 70 and the tank handle 86 near the second end 74. The ridge 88 and tank handle 86 provide surfaces for an operator to grip while removing the fuel tank 14 from the frame 18. The fuel tank 14 may be removed from the frame 18 after the quick release fasteners 54 are disengaged.

Figure 2:
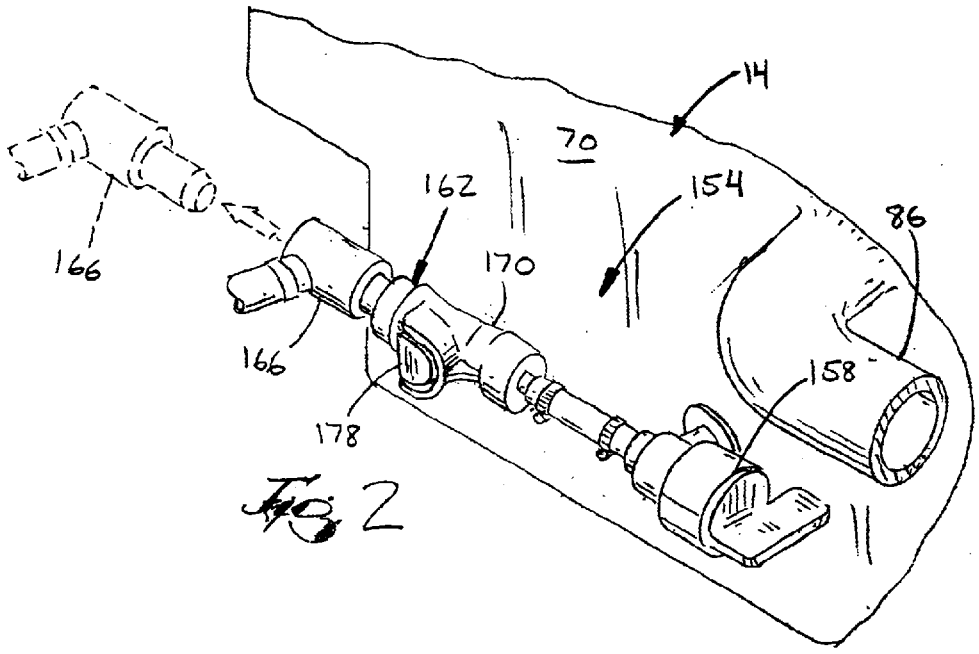
FIG. 2 is an enlarged view of a quick-disconnect fuel line on the generator of FIG. 1.

In FIG. 2, a fuel line 154 is connected to the fuel tank 14 and carries fuel from the fuel tank 14 to the engine 42 (FIG. 1). The fuel line 154 may include a shut-off valve 158 and a quick disconnect 162. The shut-off valve 158 may be actuated to stop fuel flow. Once the fuel flow is stopped, the quick disconnect 162 may be disengaged to disconnect the fuel line 154, and the fuel tank 14 may be removed from the frame 18.

In the illustrated embodiment, the quick disconnect 162 includes a plug 166 that may be inserted into a receptacle 170. The receptacle 170 may include a biased clamp 178 that clamps the plug 166 in an engaged position. The plug 166 may include an O-ring or gasket to help seal the fuel line 154. The biased clamp 178 may be actuated against the bias to unclamp the plug 166. Once the plug 166 is unclamped, the plug 166 may be detached from the receptacle 170 and moved to a disengaged position. In FIG. 2, the solid lines illustrate the plug 166 in the engaged position, and the broken lines illustrate the plug 166 in the disengaged position.

The fuel tank 14 may be removed from the frame 18 when the quick release fasteners 54 are disengaged, the shut-off valve 158 stops fuel flow, and the quick disconnect 162 of the fuel line 154 is disconnected. As mentioned above and illustrated in FIG. 3, the tank handles 86 and ridge 88 facilitate lifting the fuel tank 14 and removing the fuel tank 14 from the frame 18.

Figure 5:
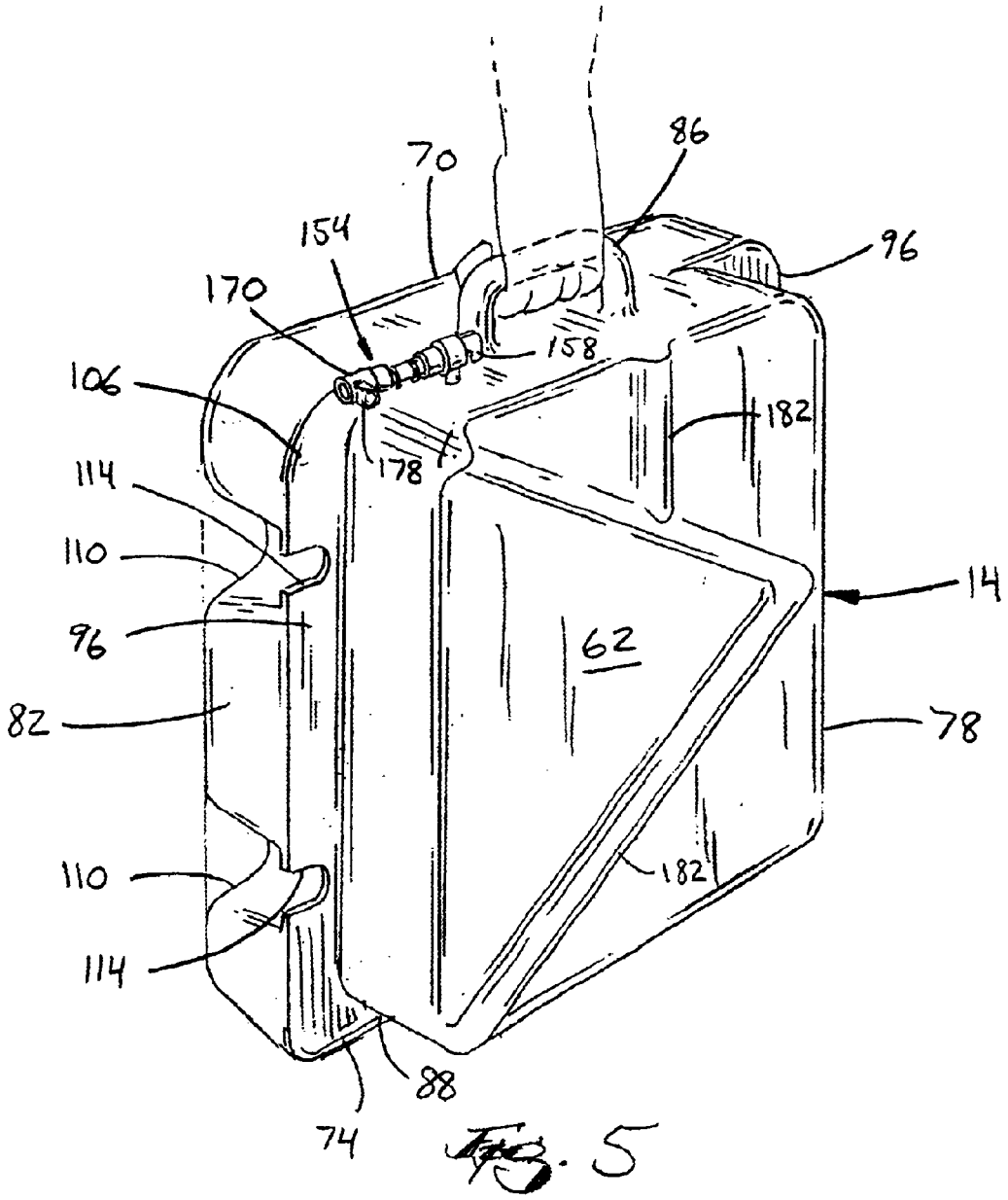
FIG. 5 is a perspective view of the fuel tank removed from the generator of FIG. 1.

FIG. 5 illustrates an operator holding the tank handle 86 and carrying the fuel tank 14. FIG. 5 also illustrates the second face 62 having a rib 182 integrally formed with the fuel tank 14. As mentioned above, the fuel tank 14 may be formed from a plastic material, and the rib 182 may help provide strength and stability for the fuel tank 14. In the illustrated embodiment, the rib 182 projects outwardly from the fuel tank 14 and extends in a V-shape along the second face 62. The rib 182 may also extend from the V-shape towards the tank handle 86 along the second face 62 for additional stability. FIG. 5 also illustrates the shut-off valve 158 and receptacle 170 of the fuel line 154 interconnected to the second end 74 of the fuel tank 14.

Since the fuel tank 14 is removable, the fuel tank 14 may be transported separately from the generator 10. In some prior art generators, a separate gasoline container may be needed to transport fuel from a gas station to the generator and refill the fuel tank. With this prior art arrangement, gasoline is transferred from the gas pump at the gasoline station to the separate gasoline container, and then transferred from the separate gasoline container to the generator. Each transfer or pour between containers provides an additional risk of spilling the gasoline. The separate gasoline container also requires extra storage space, and may not be readily available when needed.

Figure 6:
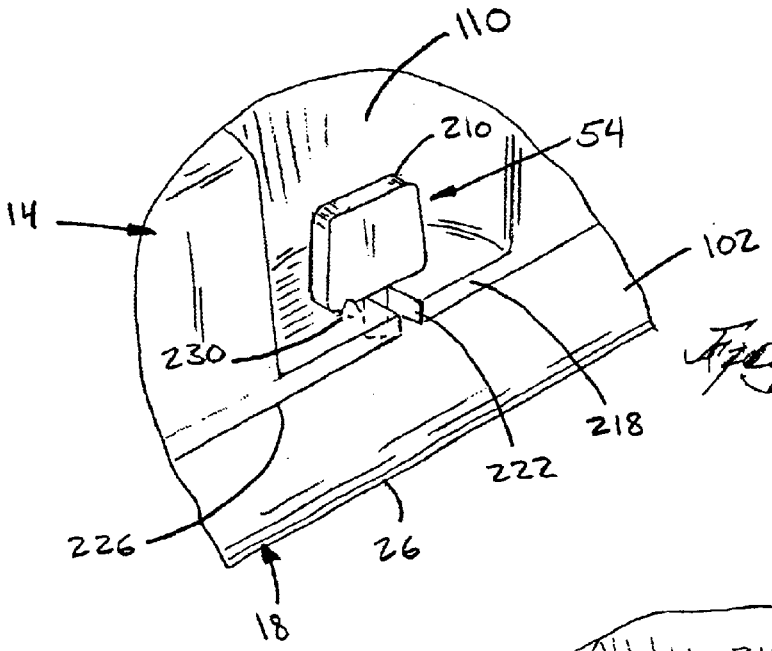
FIG. 6 is an alternate embodiment of a quick release fastener for retaining the fuel tank to the generator.

As shown in FIGS. 1, 3 and 4, the quick release fastener 54 includes the bolt 118. Other embodiments of the quick release fastener 54 may also be used to retain the fuel tank 14 to the frame 18. As shown in FIG. 6, the quick release fastener 54 includes a relatively flat tab 210 that retains the fuel tank 14 to the frame 18. The tab 210 is pivotally connected to the frame 18 and projects outwardly from the support portion 26. The tab 210 is connected to the support portion 26, and may pivot with respect to the frame 18 to engage or disengage the fuel tank 14. The fuel tank 14 includes at least one recess 110 that extends inwardly toward the fuel tank 14. A clamping portion 218 is at least partially disposed within the recess 110, and a slot 222 extends into the clamping portion 218 within the recess 110. The recess 110 and tab 210 shown in FIG. 6 may be located on the generator 10 (FIG. 1) similarly to the location of the recesses 110 and quick release fasteners 54 shown in FIGS. 1 and 3.

In FIG. 6, when connecting the fuel tank 14 to the frame 18, the fuel tank 14 is positioned above the support portion 26 such that the slots 222 are aligned with the tabs 210. The tabs 210 are pivoted to extend in the same direction as the slots 222. The fuel tank 14 is placed on the support portion 26 and the tabs 210 extend through the slots 222. The tabs 210 are in a disengaged position when the tabs 210 are aligned with the slots 222, and the tabs 210 extend in the same direction as the slots 222. The clamping portion 218 may contact a retaining surface 226 on the support portion 26. Once the tabs 210 extend through the slots 222, the tabs 210 may be pivoted 90 degrees from the disengaged position to an engaged position to clamp the clamping portion 218 to the support portion 26 and retain the fuel tank 14 to the frame 18. FIG. 6 illustrates the tab 210 in the engaged position.

The clamping portion 218 may include nubs 230 that project from the clamping portion 218 adjacent the slot 222. The nubs 230 may lock the tab 210 into the engaged position as the tab 210 is pivoted with respect to the slot 222. The nubs 230 may be aligned approximately normal to the slot 222, and the tab 210 may slightly deflect the nubs 230 as the tab 210 is rotated 90 degrees and locked into the engaged position. The tab 210 may be spring-loaded to enable it to clear the nubs 230. The nubs 230 may resist movement of the tab 210 from the engaged position to the disengaged position. The tab 210 holds the retaining surface 226 and clamping portion 218 from substantially moving with respect to each other.

To remove the fuel tank 14 from the frame 18, the tabs 210 are pivoted to the disengaged position to align the tabs 210 with the slots 222. The quick disconnect 162 (FIG. 2) is disengaged to disconnect the fuel tank 14 from the frame 18. The fuel tank 14 may then be removed from the frame 18.

Figure 7:
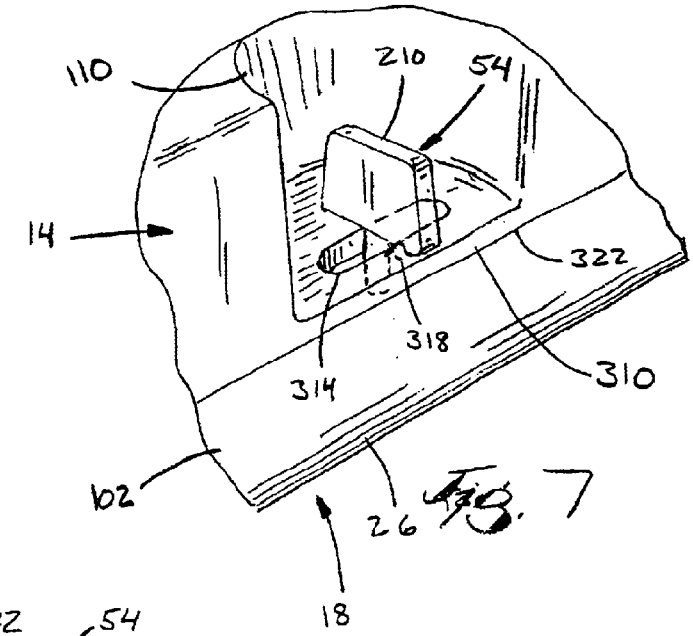
FIG. 7 is an alternate embodiment of a quick release fastener for retaining the fuel tank to the generator.

FIG. 7 illustrates a variation of the embodiment shown in FIG. 6. In FIG. 7, the fuel tank 14 extends over the elongated rods 102 of the frame 18, and includes at least one recess 110 that provides clearance for the quick release fastener 54, which includes the tab 210. Once again, the tab 210 may pivot with respect to the frame 18 to engage or disengage the fuel tank 14. A clamping portion 310 is at least partially disposed within the recess 110, and the clamping portion 310 includes an elongated slot 314. Similar to the previously described embodiment, the fuel tank 14 is initially positioned on the support portion 26 such that the slots 314 are aligned with the tabs 210.

In the illustrated embodiment, the slot 314 is enclosed within the clamping portion 310, and the slot 314 extends in substantially the same direction as the elongated rod 102. Alternatively, the slots 414 could extend in any direction relative to the elongated rod 102, as long as the tab 210 may be aligned with the slot 314. Once the fuel tank 14 is positioned on the support portion 26 and the tab 210 extends through the slot 314, the tab 210 may be pivoted 90 degrees from the disengaged position to the engaged position to clamp the clamping portion 310 and retain the fuel tank 14 to the frame 18. FIG. 7 illustrates the tab 210 in the engaged position.

As described above, the clamping portion 310 may include nubs 318 that project from the clamping portion 310 adjacent the slot 314. The nubs 318 may lock the tab 210 into an engaged position as the tab 210 is pivoted with respect to the slot 314. Tab 210 may be spring-loaded to enable it to clear nubs 318. The support portion 26 includes a retaining surface 322, and the tab 210 holds the retaining surface 322 and clamping portion 310 from substantially moving with respect to each other. To remove the fuel tank 14, the tabs 310 are pivoted to the disengage position and aligned with the slots 414, and the quick disconnect 162 (FIG. 3) is disengaged. The fuel tank 14 may then be removed from the frame 18.

Figure 8:
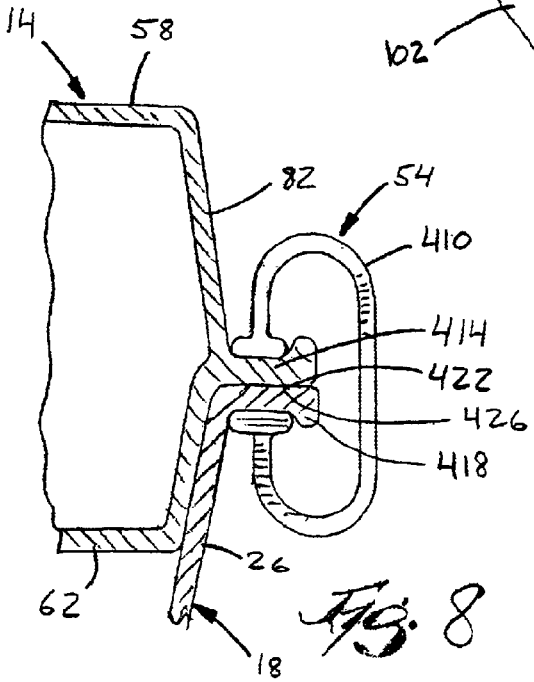
FIG. 8 is an alternate embodiment of a quick release fastener for retaining the fuel tank to the generator.

FIG. 8 illustrates another alternate embodiment of the quick release fastener 54 that includes a C-shaped clamp 410 that retains the fuel tank 14 to the frame 18. The fuel tank 14 includes a flange 414 that projects outwardly from the fuel tank 14 and extends along the sides 78, 82 of the fuel tank 14. The support portion 26 includes a lip 418 that is adjacent to the flange 414 when the fuel tank 14 is retained to the frame 18. The flange 414 includes a clamping portion 422, and the lip 418 includes a retaining surface 426. The clamp 210 is engaged to clamp the flange 414 to the lip 418 and retain the fuel tank 14 to the frame 18. The clamp 410 holds the retaining surface 426 and clamping portion 422 from substantially moving with respect to each other. The clamp 410 may be disengaged from the flange 414 to remove the fuel tank 14 from the frame 18.

One skilled in the art will recognize that many variations of these illustrated embodiments of quick release fasteners 54 may be implemented to retain the removable fuel tank 10 to the frame 18. For example, the quick release fasteners 54, bolts 118 and tabs 210 (FIGS. 3–4 and 6–7) may be adapted to engage with an aperture in the flange 414 (FIG. 8). Additionally, the flange 414 (FIG. 8) may be combined with the support portion 26 having the elongated rod 112 (FIGS. 3–4 and 6–7) or the lip 418 (FIG. 8). Similarly, the lip 418 (FIG. 8) may also be combined with the recess 110 (FIGS. 3–4 and 6–7) and quick release fastener 54. These and other similar embodiments of quick release fasteners 54 may be used to retain the fuel tank 14 to the frame 18.

The foregoing detailed description describes only a few of the many forms that the present invention can take, and should therefore be taken as illustrative rather than limiting. It is only the following claims, including all equivalents that are intended to define the scope of the invention.

What is claimed is:

1. A generator comprising a frame having a retaining surface;

an engine supported by the frame;

a fuel tank removably interconnected to the frame, the fuel tank comprising:

a first face and a second face disposed opposite one another;

a wall extending between the first face and second face;

a clamping portion adjacent the wall; and at least one quick release fastener that retains the fuel tank to the frame, and holds the retaining surface and the clamping portion from substantially moving with respect to each other.

2. The generator of claim 1, wherein the wall includes a first and second end wall disposed opposite one another, and a first and second side wall disposed opposite one another and adjacent the end walls, and the clamping portion is adjacent at least one of the first and second side walls.

3. The generator of claim 1, further comprising at least one recess disposed in the wall, wherein the clamping portion is at least partially disposed within the recess.

4. The generator of claim 1, further comprising:

a handle that projects outwardly from the fuel tank.

5. The generator of claim 1, wherein the wall includes a ridge extending from the wall.

6. The generator of claim 1, wherein the at least one quick release fastener includes a hand-tightened bolt having a threaded end that threadedly engages the frame, and a head end having a handle thereon.

7. The generator of claim 6, wherein the bolt includes a disc-shaped flange that projects radially outward from the bolt adjacent the threaded end.

8. The generator of claim 7, wherein the flange contacts said clamping portion.

9. The generator of claim 1, further comprising at least one recess disposed in the wall, wherein the clamping portion is at least partially disposed within the recess, and the clamping portion includes an aperture.

10. The generator of claim 9, wherein the at least one quick release fastener includes a bolt that extends through the aperture to retain the fuel tank to the frame.

11. The generator of claim 1, wherein the at least one quick release fastener includes a clamp that applies pressure on the clamping portion to retain the fuel tank to the frame.

12. The generator of claim 11, wherein the clamp is substantially C-shaped.

13. The generator of claim 1, wherein the at least one quick release fastener includes a tab pivotally connected to the frame adjacent the retaining surface.

14. The generator of claim 13, wherein the clamping portion has an elongated slot that engages the tab.

15. The generator of claim 14, wherein the tab is pivotable between a disengaged position in which the tab is aligned with the slot, and an engaged position in which the tab is rotated approximately 90 degrees with respect to the slot to prevent the tab from sliding through the slot, and wherein the fuel tank is retained to the frame when the tab is in the engaged position.

16. The generator of claim 1, wherein the first face includes a fuel opening, and a removable fuel cap that encloses the fuel opening.

17. The generator of claim 16, wherein the fuel cap is vented.

18. The generator of claim 1, further comprising a fuel line that extends from the fuel tank to the engine to provide fuel for the engine, and includes a shut-off valve interconnected to selectively prevent fuel flow through the fuel line.

19. The generator of claim 18, wherein the fuel line includes a quick disconnect that permits the fuel tank to be readily connected and disconnected from the generator.

* * * * *